US007867092B2

(12) United States Patent
Paulsen

(10) Patent No.: US 7,867,092 B2
(45) Date of Patent: Jan. 11, 2011

(54) GAMING APPARATUS WITH AN OPTICAL WIRELESS SYSTEM

(75) Inventor: Craig A. Paulsen, Reno, NV (US)

(73) Assignee: IGT, Reno, NV (US)

( * ) Notice: Subject to any disclaimer, the term of this patent is extended or adjusted under 35 U.S.C. 154(b) by 588 days.

(21) Appl. No.: 10/118,414

(22) Filed: Apr. 8, 2002

(65) Prior Publication Data

US 2003/0190958 A1 Oct. 9, 2003

(51) Int. Cl.
*A63F 9/24* (2006.01)

(52) U.S. Cl. ..... 463/42

(58) Field of Classification Search ..... 463/1, 463/16–22, 29–31, 39–42, 46; 398/45, 49, 398/50, 58, 59, 107, 66–70, 106, 115–118, 398/127–130, 135, 138, 140, 165, 167.5; 359/350; 370/310, 310.1, 310.2, 312, 313, 370/328, 498, 536

See application file for complete search history.

(56) References Cited

U.S. PATENT DOCUMENTS 4,335,809 A * 6/1982 Wain ..... 463/20
4,964,638 A * 10/1990 Ishida ..... 463/27
5,083,800 A * 1/1992 Lockton ..... 463/42
5,099,346 A 3/1992 Lee et al. ..... 359/118
5,222,583 A * 6/1993 Bergmann et al. ..... 194/206
5,247,380 A * 9/1993 Lee et al. ..... 398/118
5,416,627 A * 5/1995 Wilmoth ..... 398/129
5,477,952 A * 12/1995 Castellano et al. ..... 194/200
5,600,471 A * 2/1997 Hirohashi et al. ..... 398/136
5,605,506 A * 2/1997 Hoorn et al. ..... 463/42
5,741,184 A * 4/1998 Takemoto et al. ..... 463/43

(Continued)

FOREIGN PATENT DOCUMENTS

CA 2273458 1/2000

(Continued)

OTHER PUBLICATIONS

"Infrared Data Association (IrDA) Releases Infrared Financial Messaging (IrFM) Universal Wireless 'Point & Pay' Standard for Public Review," Infrared Data Association, pp. 1-2, dated Feb. 5, 2002.

(Continued)

*Primary Examiner*—Pierre E Elisca
(74) *Attorney, Agent, or Firm*—Weaver Austin Villeneuve & Sampson LLP

(57) ABSTRACT

A casino gaming unit may include a display unit that is capable of generating video images, a value input device, a gaming unit controller operatively coupled to the display unit and the value input device, an optical communication transceiver capable of wireless data transmission and reception, and an optical communication controller coupled to the optical communication transceiver and the gaming unit controller. The gaming unit controller may comprise a processor and a memory and may allow a person to make a wager, to cause a video image representing a game to be generated on the display unit, to determine an outcome of the game, and a value payout associated with the outcome of the game. The optical communication controller may facilitate wireless data communication with an optical communication transceivers of one or more devices at locations remote from the gaming unit.

12 Claims, 14 Drawing Sheets

U.S. PATENT DOCUMENTS

| | | | | |
|---|---|---|---|---|
| 5,781,177 | A * | 7/1998 | Helot et al. | 345/156 |
| 5,786,923 | A * | 7/1998 | Doucet et al. | 398/122 |
| 5,818,814 | A * | 10/1998 | Testani et al. | 370/212 |
| 5,978,117 | A * | 11/1999 | Koonen | 398/116 |
| 5,986,787 | A * | 11/1999 | Ohshima et al. | 398/127 |
| 6,003,013 | A * | 12/1999 | Boushy et al. | 705/10 |
| 6,009,096 | A * | 12/1999 | Jaisingh et al. | 370/310.1 |
| 6,050,898 | A * | 4/2000 | Vange et al. | 463/42 |
| 6,058,106 | A | 5/2000 | Cudak et al. | 370/313 |
| 6,067,583 | A | 5/2000 | Gilbert | 710/8 |
| 6,128,117 | A * | 10/2000 | Kim | 398/115 |
| 6,131,121 | A * | 10/2000 | Mattaway et al. | 709/227 |
| 6,150,993 | A | 11/2000 | Dobrovolny | 343/853 |
| 6,234,898 | B1 | 5/2001 | Belamant et al. | |
| 6,270,410 | B1 * | 8/2001 | DeMar et al. | 463/20 |
| 6,285,868 | B1 * | 9/2001 | LaDue | 455/410 |
| 6,296,101 | B1 * | 10/2001 | Hasegawa et al. | 194/217 |
| 6,312,332 | B1 * | 11/2001 | Walker et al. | 463/23 |
| 6,314,163 | B1 * | 11/2001 | Acampora | 379/56.2 |
| 6,323,980 | B1 * | 11/2001 | Bloom | 398/129 |
| 6,339,731 | B1 * | 1/2002 | Morris et al. | 700/236 |
| 6,347,996 | B1 | 2/2002 | Gilmore et al. | |
| 6,348,986 | B1 * | 2/2002 | Doucet et al. | 398/128 |
| 6,424,819 | B1 | 7/2002 | Yan | |
| 6,442,145 | B1 * | 8/2002 | De Lange et al. | 370/310 |
| 6,480,313 | B1 * | 11/2002 | Kawamura | 398/173 |
| 6,508,709 | B1 * | 1/2003 | Karmarkar | 463/42 |
| 6,525,855 | B1 * | 2/2003 | Westbrook et al. | 398/168 |
| 6,579,184 | B1 * | 6/2003 | Tanskanen | 463/41 |
| 6,645,078 | B1 * | 11/2003 | Mattice | 463/42 |
| 6,665,279 | B1 * | 12/2003 | Kwak et al. | 370/328 |
| 6,693,879 | B1 * | 2/2004 | Kawamura et al. | 370/235 |
| 6,701,092 | B2 * | 3/2004 | Doucet et al. | 398/128 |
| 6,771,904 | B1 * | 8/2004 | Sasaki et al. | 398/25 |
| 6,807,178 | B1 * | 10/2004 | Lemieux | 370/395.2 |
| 2003/0016418 | A1 * | 1/2003 | Westbrook et al. | 359/145 |
| 2003/0036430 | A1 * | 2/2003 | Cannon | 463/42 |
| 2003/0109310 | A1 * | 6/2003 | Heaton et al. | 463/42 |
| 2003/0125112 | A1 * | 7/2003 | Silvester | 463/42 |
| 2004/0029638 | A1 * | 2/2004 | Hytcheson et al. | 463/42 |
| 2009/0291752 | A1 * | 11/2009 | Anderson et al. | 463/25 |
| 2009/0305776 | A1 * | 12/2009 | Englman et al. | 463/25 |
| 2010/0062843 | A1 * | 3/2010 | Gagner et al. | 463/27 |

FOREIGN PATENT DOCUMENTS

| | | |
|---|---|---|
| DE | 198 55 117 | 5/2000 |
| RU | 2145116 | 1/2000 |
| RU | 2144264 | 10/2000 |
| RU | 17678 | 4/2001 |
| RU | 2170947 | 7/2001 |
| WO | WO 96/21914 | 7/1996 |
| WO | WO 03/083798 | 10/2003 |

OTHER PUBLICATIONS

International Search Report dated Nov. 29, 2002 for PCT/US02/09967.

Australian Examination Report dated Feb. 10, 2009 issued in 2007234482.

L.M. Nevdjaev, "Telecommunicational Technologies," pp. 240-241 (Moscow, Russia, Dec. 3, 2001).

V.G. Kartachevsky, "Networks of Moving Constraint," Eko-trends, p. 35 (2001).

Russian Office Action dated Dec. 14, 2005 issued in 2004131663, English translation, 8 pages.

* cited by examiner

FIG. 10
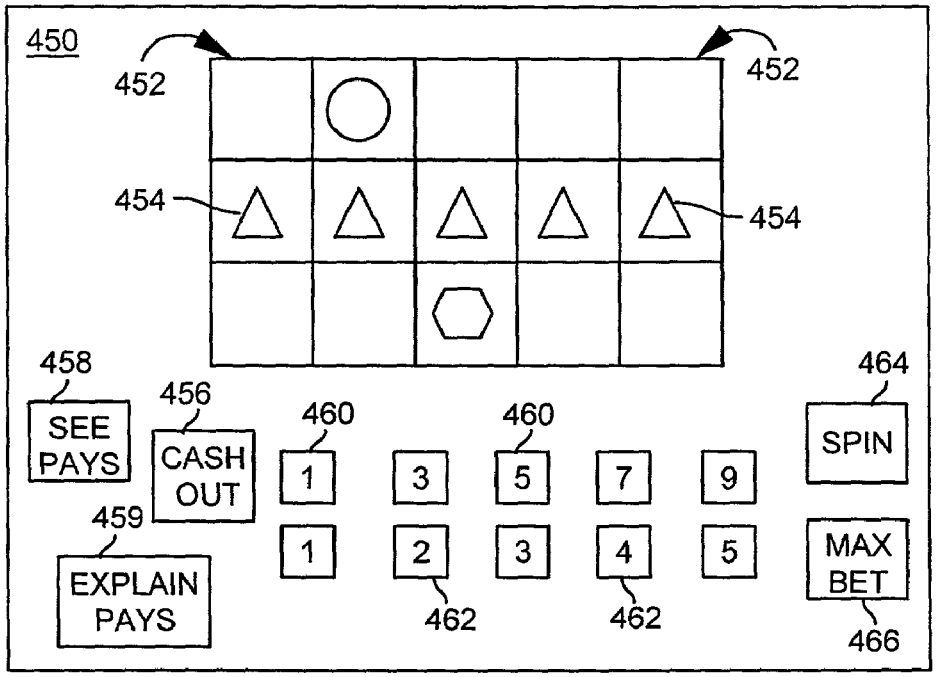
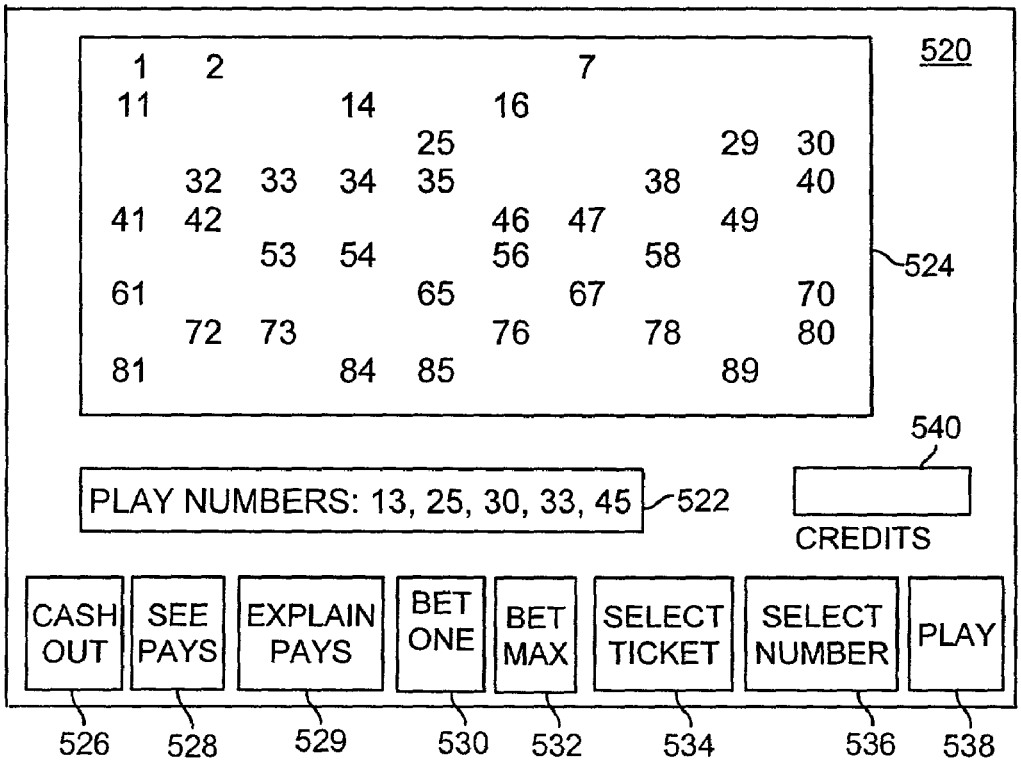
FIG. 11

GAMING APPARATUS WITH AN OPTICAL WIRELESS SYSTEM

BACKGROUND

This patent is directed to gaming apparatus, which could be either an individual gaming unit or a casino gaming network having multiple gaming units, that is capable of wireless data transmission and receipt.

Typically, a gaming unit has been provided with a display unit that is capable of generating video images, a coin or bill acceptor, and a controller with a memory and a processor that controls the overall operation of the gaming unit. The controller was programmed to allow a person to make a wager, to cause video images to be generated on the display unit, to determine an outcome of the video gambling game, and to determine a value payout associated with the outcome of the game. The conventional gaming unit also was programmed to display video images representing a game, which included a number of user-selectable video gambling games including video poker, video blackjack, video slots, video keno, video bingo, video pachinko games, video card games, video games of chance, and combinations thereof.

Traditionally, gaming units and/or gaming networks were interconnected using copper wire cable. Later, fiber optical cable was used to provide a stable, low loss, guided propagation path for carrying data between and among gaming units and gaming networks. Fiber optical cable was also used to connect gaming units to other gaming devices such as player tracking systems and progressive jackpot systems. Due to the nature of the both types of cabling, each segment of the copper wire cable and the fiber optic cable used in the gaming network required physical coupling to essentially fixed-position system connections such as a fixed-position connector, a floor or wall mounted receptacle, etc,. and sometimes required running through ceiling panels, along baseboards, under floor panels, and throughout other areas of the casino. Casinos reconfigure their gaming machines to accomplish various changes including, for example, the addition of new gaming machines, customer preferences, optimizing game play time, traffic patterns, etc.

SUMMARY OF THE INVENTION

In one aspect, the invention is directed to a casino gaming unit that may include a display unit that is capable of generating video images, a value input device, a gaming unit controller operatively coupled to the display unit and the value input device, an optical communication transceiver capable of wireless data transmission and reception, and an optical communication controller coupled to the optical communication transceiver and the gaming unit controller. The gaming unit controller may comprise a processor and a memory operatively coupled to the processor of the gaming unit controller and may allow a person to make a wager, to cause a video image representing a game to be generated on the display unit, to determine an outcome of the game and a value payout associated with the outcome of the game.

The video image may represent a video game selected from the group of video games consisting of video poker, video blackjack, video slots, video keno, video pachinko, and video bingo, in which case the video image may comprise an image of at least five playing cards if the video gambling game comprises video poker; the video image may comprise an image of a plurality of simulated slot machine reels if the video gambling game comprises video slots; the video image may comprise an image of a plurality of playing cards if the video gambling game comprises video blackjack; the video image may comprise an image of a plurality of keno numbers if the video gambling game comprises video keno; the video image may comprise an image of a plurality of moving balls and obstacles, and the video image may comprise an image of a bingo grid if the video gambling game comprises video bingo.

The optical communication controller may comprise a processor and a memory operatively coupled to the processor of the optical communication controller and may allow wireless data communication with an optical communication transceiver of another device at a location remote from the gaming apparatus.

The optical communication transceiver may comprise a photoemissive device capable of generating infrared light and a photoreceptor device capable of receiving infrared light. The photoemissive device may comprise a laser diode or a light emitting diode and may be capable of point-to-point or point-to-multipoint communication.

In another aspect, the invention is directed to a gaming system comprising a first gaming unit, a second gaming unit, and a routing device. Each of the gaming units may include a display unit that is capable of generating video images, a value input device, a gaming unit controller operatively coupled to the display unit and the value input device, an optical communication transceiver capable of wireless data transmission and reception, and an optical communication controller coupled to the optical communication transceiver and the gaming unit controller. The gaming unit controller may comprise a processor and a memory operatively coupled to the processor of the gaming unit controller and may allow a person to make a wager, to cause a video image representing a game to be generated on the display unit, to determine said outcome of the and a value payout associated with the outcome of the game.

The optical communication controller may comprise a processor and a memory operatively coupled to the processor of the optical communication controller and may allow wireless data communication with an optical communication transceiver of another device at a location remote from the gaming apparatus.

The routing device may comprise an optical communication transceiver capable of wireless data transmission and reception, and a routing device controller. The routing device controller my comprise a processor and a memory operatively coupled to the processor of the routing device controller and may allow communication with the optical communication transceivers of the first and second gaming units.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 10 is an illustration of an embodiment of a visual display that may be displayed during performance of the slots routine of FIG. 12;

FIG. 11 is an illustration of an embodiment of a visual display that may be displayed during performance of the video keno routine of FIG. 13;

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, it is not intended that the scope of any claim element be interpreted based on the application of 35 U.S.C. §112, sixth paragraph.

Figure 1A:
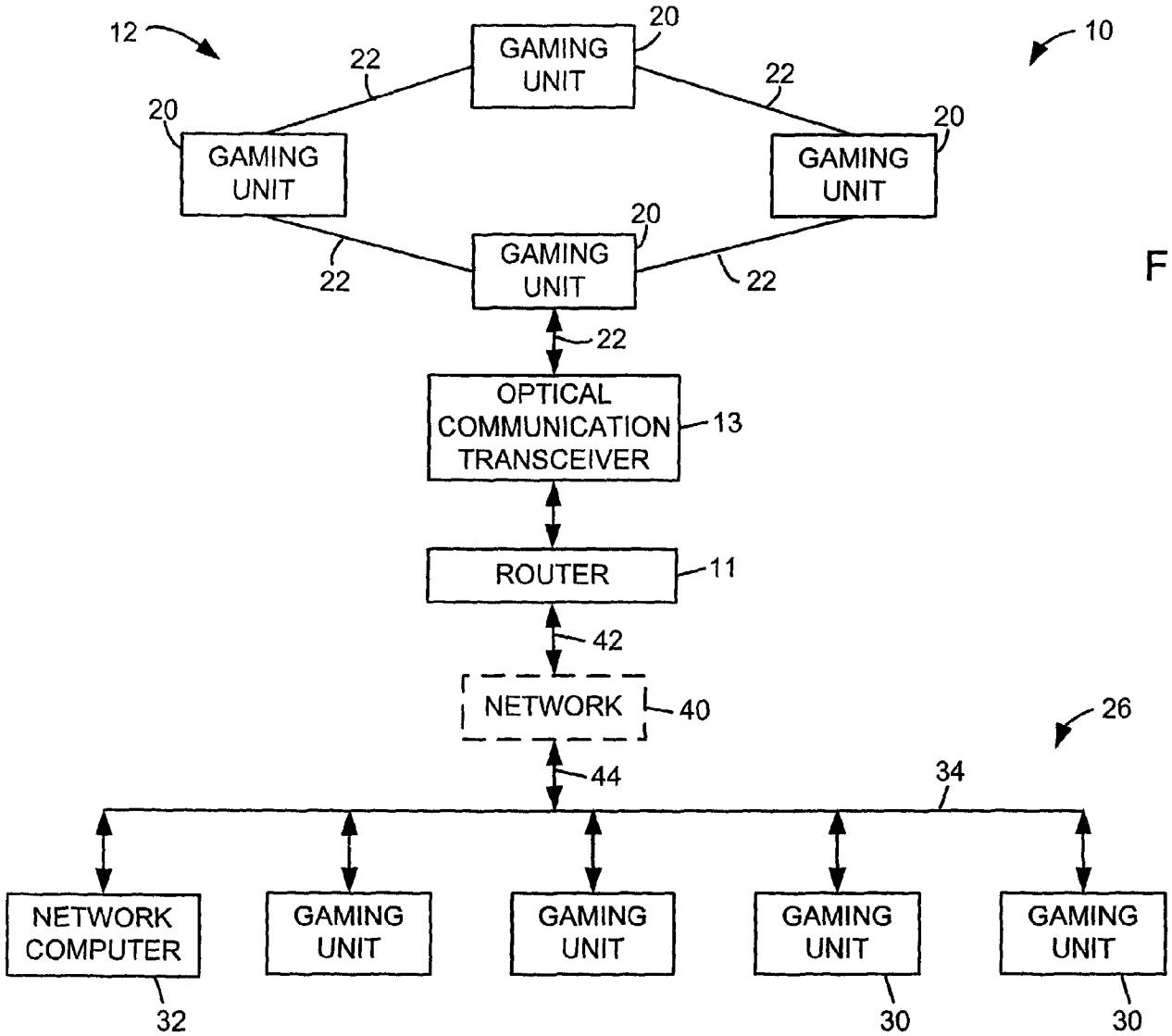
FIG. 1A is a block diagram of an embodiment of a gaming system in accordance with the invention.

FIG. 1A illustrates one possible embodiment of a casino gaming system 10 in accordance with the invention. Referring to FIG. 1A, the casino gaming system 10 may include a first group or network 12 of casino gaming units 20. Each of the gaming units may be operatively coupled to another gaming unit 20 via an optical wireless link 22 capable of two-way digital data exchange.

In addition, a common optical communication transceiver 13 may be operatively coupled to one of the gaming units 20 via the optical wireless link 22. The common optical communication transceiver 13 may include an optical communication transceiver controller configured to facilitate wireless data transmission and reception to and from the first network 12. The common optical communication transceiver 13 may be operatively coupled to a router 11. The router 11 may include a router controller configured to facilitate data routing between the first network 12 and a network 40. The router 11 may route data traffic, based on a number of well known routing considerations, between the first network 12 and the network 40 via one of the of the gaming units 20. Further, a network computer (not shown) may be operatively coupled to each of the gaming units 20 via a network data link or bus which may also be configured as an optical wireless link. Although the common optical communication transceiver 13 and the router 11 are shown as two separate elements, each having their own controller, it should be understood that the common optical communication transceiver 13 and the router 11 and their respective controllers may be combined into one element. Accordingly, the configuration of the casino gaming system 10 including the use of optical wireless links, may allow the gaming unit(s) 20, the common optical communication transceiver 13, and the router 11 to be easily relocated.

The casino gaming system 10 may also include a second group or network 26 of casino gaming units 30 operatively coupled to a network computer 32 via a network data link or bus 34 which may be an optical wireless link. The first and second gaming networks 12, 26 may be operatively coupled to each other via the network 40, which may comprise, for example, the Internet, a wide area network (WAN), or a local area network (LAN) via a first network link 42 and a second network link 44. The first network link 42 and the second network link 44 may comprise a copper wire cable, a fiber optical cable, an optical wireless link, or any other suitable link capable of transmitting and receiving data.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. In addition, the network 40 may include a plurality of network computers or server computers (not shown), each of which may be operatively interconnected. Where the network 40 comprises the Internet, data communication may take place over the communication links 42, 44 via an Internet communication protocol.

The network computer 32 may be a server computer and may be used to accumulate and analyze data relating to the operation of the gaming units 30. For example, the network computer 32 may continuously receive data from each of the gaming units 30 indicative of the dollar amount and number of wagers being made on each of the gaming units 30, data indicative of how much each of the gaming units 30 is paying out in winnings, data regarding the identity and gaming habits of players playing each of the gaming units 30, etc. Similarly, the network computer operatively coupled to the gaming units 20 may be a server computer and may be used to perform the same or different functions in relation to the gaming units 20 as the network computer 32 described above.

Figure 1B:
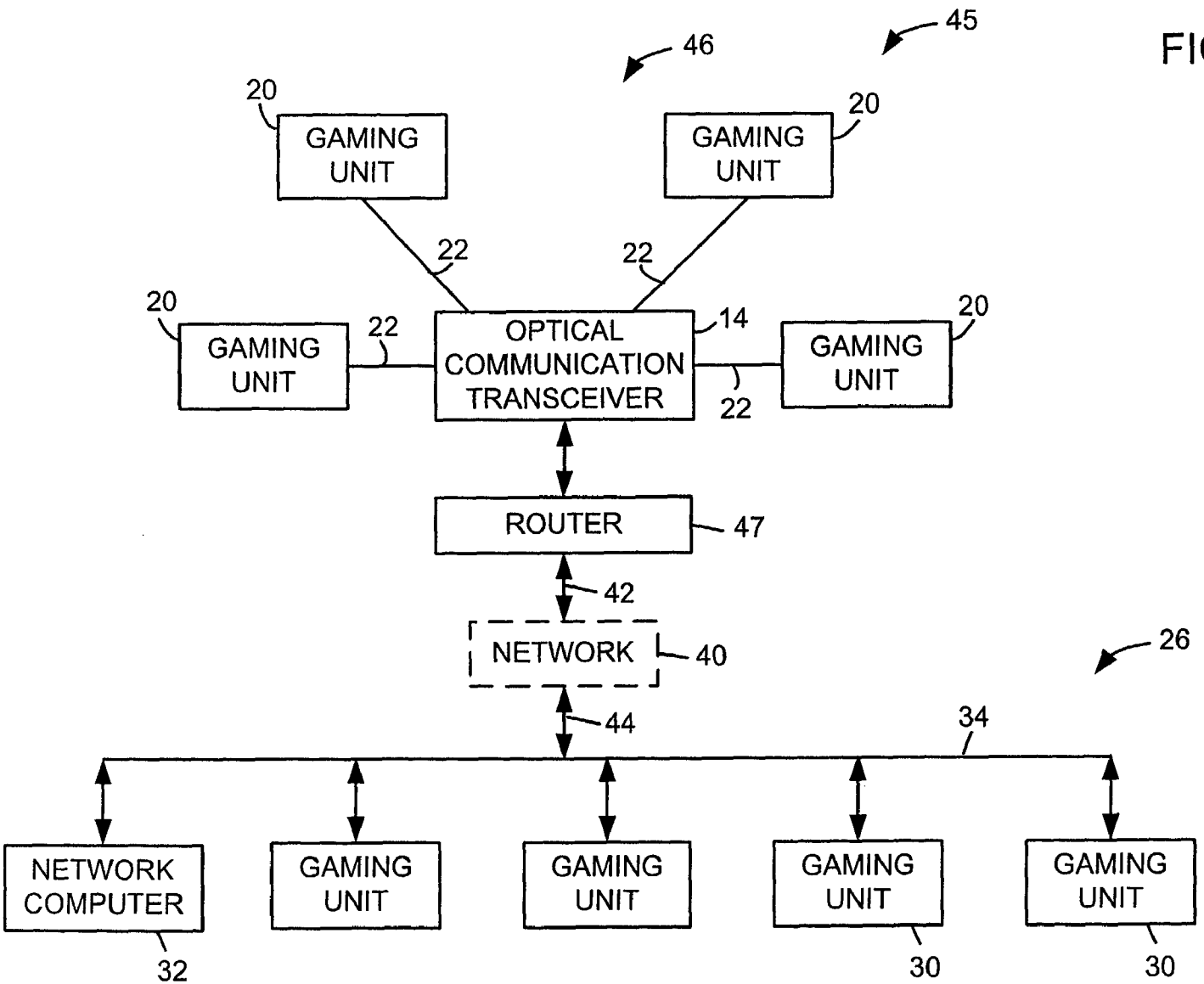
FIG. 1B is a block diagram of an alternative embodiment of a gaming system in accordance with the invention.

FIG. 1B illustrates another possible embodiment of a casino gaming system 45 in accordance with the invention. Referring to FIG. 1B, the casino gaming system 45 may include a first group or network 46 of casino gaming unit(s) 20. Each of the gaming units 20 may include an optical transceiver that may be operatively coupled to a common optical communication transceiver 14 via an optical wireless link 22 capable of two-way digital data exchange. The common optical communication transceiver 14 may include an optical communication transceiver controller configured to facilitate wireless data reception and transmission capability to and from the gaming units 20.

In addition, the optical communication transceiver 14 may be operatively coupled to a central router 47. The central router 47 may include a central router controller configured to facilitate data routing between the common optical transceiver 14 and a network 40 via a first network link 42. The central router 47 may route data traffic between the first network 46 and the network 40 based on a number of well known routing considerations. Further, a network computer (not shown) may be operatively coupled to each the gaming units 20 via a network data link or bus that may also be configured as an optical wireless link. Although the optical communication transceiver 14 and the central router 47 are shown as two separate elements, each having their own controller, it should be understood that the optical communication transceiver 14 and the central router 47 and their respective controllers may be combined into one element. Accordingly, the configuration of the casino gaming system 45 including the use of optical wireless links, may allow the gaming unit(s) 20, the common optical communication transceiver 14, and the router 45 to be easily relocated.

The casino gaming system 10 may also include a second group or network 26 of casino gaming units 30 operatively coupled to a network computer 32 via a network data link or bus 34 which may be an optical wireless link. The first and second gaming networks 12, 26 may be operatively coupled to each other via the network 40, which may comprise, for example, the Internet, a wide area network (WAN), or a local area network (LAN) via a first network link 42 and a second network link 44. The first network link 42 and the second network link 44 may comprise a copper wire cable, a fiber optical cable, an optical wireless link, or any other suitable link capable of transmitting and receiving data.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 32 may be a server computer and may be used to accumulate and analyze data relating to the operation of the gaming units 30. For example, the network computer 32 may continuously receive data from each of the gaming units 30 indicative of the dollar amount and number of wagers being made on each of the gaming units 30, data indicative of how much each of the gaming units 30 is paying out in winnings, data regarding the identity and gaming habits of players playing each of the gaming units 30, etc. Similarly, the network computer operatively coupled to the gaming units 20 may be a server computer and may be used to perform the same or different functions in relation to the gaming units 20 as the network computer 32 described above.

Although each network 12, 26 is shown to include four gaming units 20, 30, it should be understood that different numbers of computers and gaming units may be utilized. For example, the network 12 may include a plurality of network computers and tens or hundreds of gaming units 20, all of which may be interconnected via wireless data links such as an optical data link.

Figure 2:
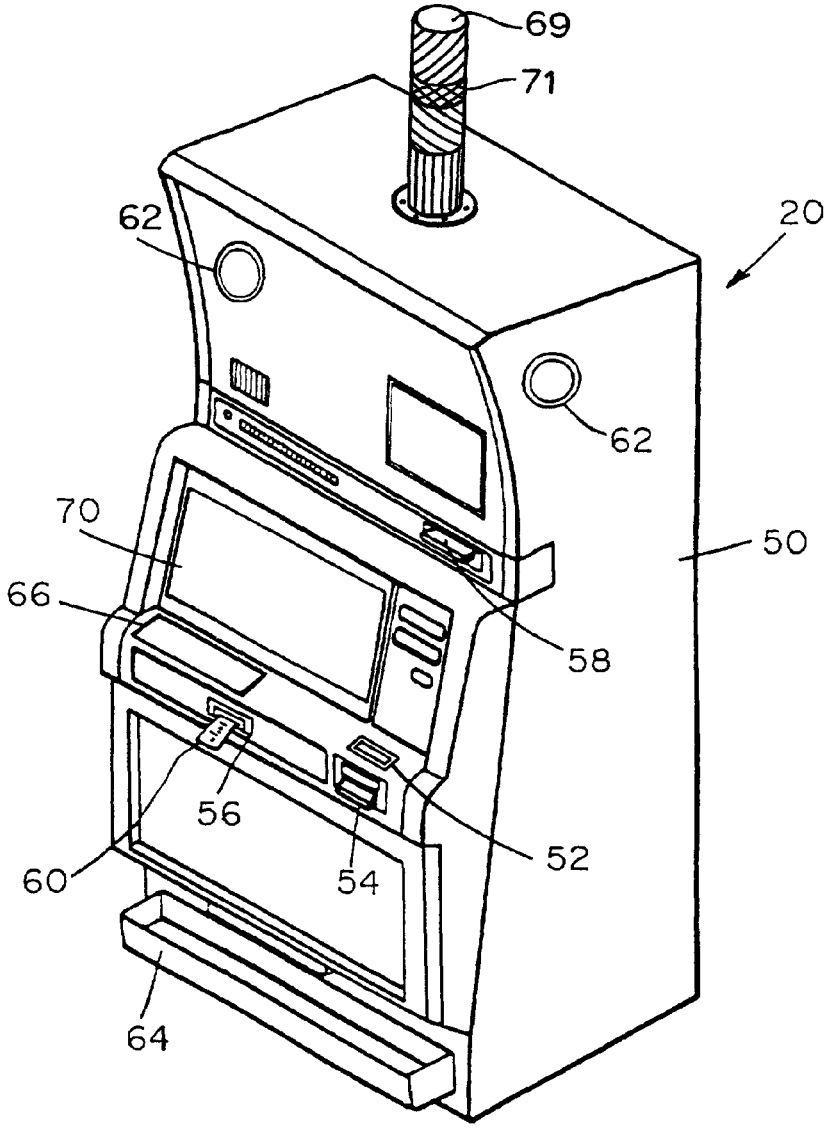
FIG. 2 is a perspective view of an embodiment of one of the gaming units shown schematically in FIGS. 1A and 1B.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more value input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, smart cards and any other object representative of value.

The gaming unit 20 may also include an indicator, herein referred to as a candle 69, mounted on top of the gaming machine 20 to provide a quick visual indication of the gaming machine 20. The candle 69 may be constructed as a clear tube containing a variety of color inserts, which when illuminated in predetermined patterns, indicate a quick visual status of the gaming machine 20. For example, a yellow illumination may signify to a player that the gaming machine 20 requires 25 cent denominations. In another example, a flashing pattern of multiple colors may indicate that the gaming machine is in an attract mode or a player mode, or that a player has won a jackpot, or that the gaming unit 20 is malfunctioning.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, an input control panel 66, and a color video display unit 70 for displaying images relating to the game or games provided by the gaming unit 20. The audio speakers 62 may generate audio representing sounds such as the noise of spinning slot machine reels, a dealer's voice, music, announcements or any other audio related to a casino game. The input control panel 66 may be provided with a plurality of pushbuttons or touch-sensitive areas that may be pressed by a player to select games, make wagers, make gaming decisions, etc.

The gaming unit 20 may also include one or more built-in optical interface port(s), or infrared (IR) transceiver(s) 71. The IR transceiver(s) 71 may be configured to optically transmit data to, and receive data from, other infrared-equipped gaming units or devices. Thus, the IR transceiver(s) 71 may transmit data, encrypted and/or unencrypted, between gaming unit(s) 20 or to other infrared-equipped remote devices. The data may include, for example, player tracking card data such as player names, points accumulated, etc., progressive jackpot machine data, software download data, game bonusing data, etc. Similarly, The IR transceiver(s) 71 may receive data, encrypted and/or unencrypted, from gaming unit(s) 20 or other remote devices such as router 11 and central router 46.

The IR transceiver 71 may be configured in any number of configurations to enable bidirectional optical transmission of data. For example, the IR transceiver 71 may include a photoemissive device such as an array of infrared light emitting diodes (LED) for producing a transmitted optical signal, and a photoreceptor device such as an array of infrared sensitive photodiodes for receiving and converting a received optical signal to a reception signal. Similarly, the IR transceiver 71 may include a photoemissive device such as an array of low-power laser diodes conforming to Class 1 eye safety standards, and a photoreceptor device such as an array of infrared sensitive photodiodes. Further, the IR transceiver 71 may be installed in any suitable area of the gaming unit 20, for example in the candle 69, in order to carry high speed data over light waves to other infrared-equipped gaming units or peripheral devices at transmission rates of up to 1 Gbps. The IR transceiver 71 may be configured to carry data in a either point-to-point or point-to-multipoint application. For example, it may be desirable to utilize a point-to-multipoint application in order to facilitate a software download from a network server to a number of gaming units 20 via optical links. In addition, placement of the IR transceiver 71 in the candle 69 or similar location, may provide enhanced security for optically transmitted data when compared with data transmitted via a wire or fiber optic link. It should be noted that although the IR transceiver 71 is depicted in FIG. 2 as being a radially disposed in the candle 69, it should be understood that the IR transceiver 71 may be mounted in any location that increases or maximizes line-of-sight with other infrared-equipped gaming units or remote devices.

Figure 2A:
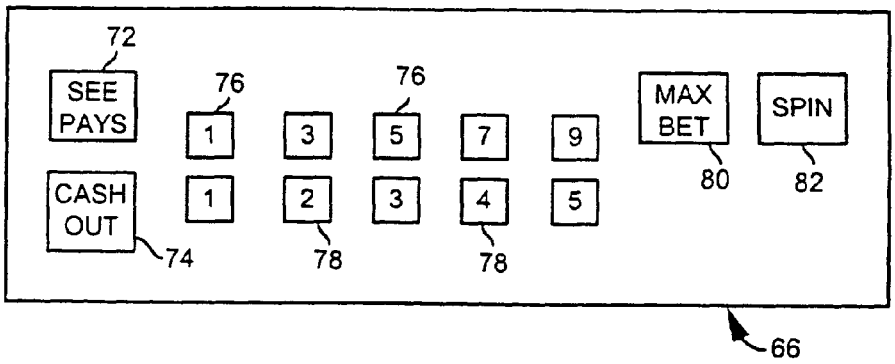
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 76, 78, 80, 82. It should be understood that rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Gaming Unit Electronics

Figure 3:
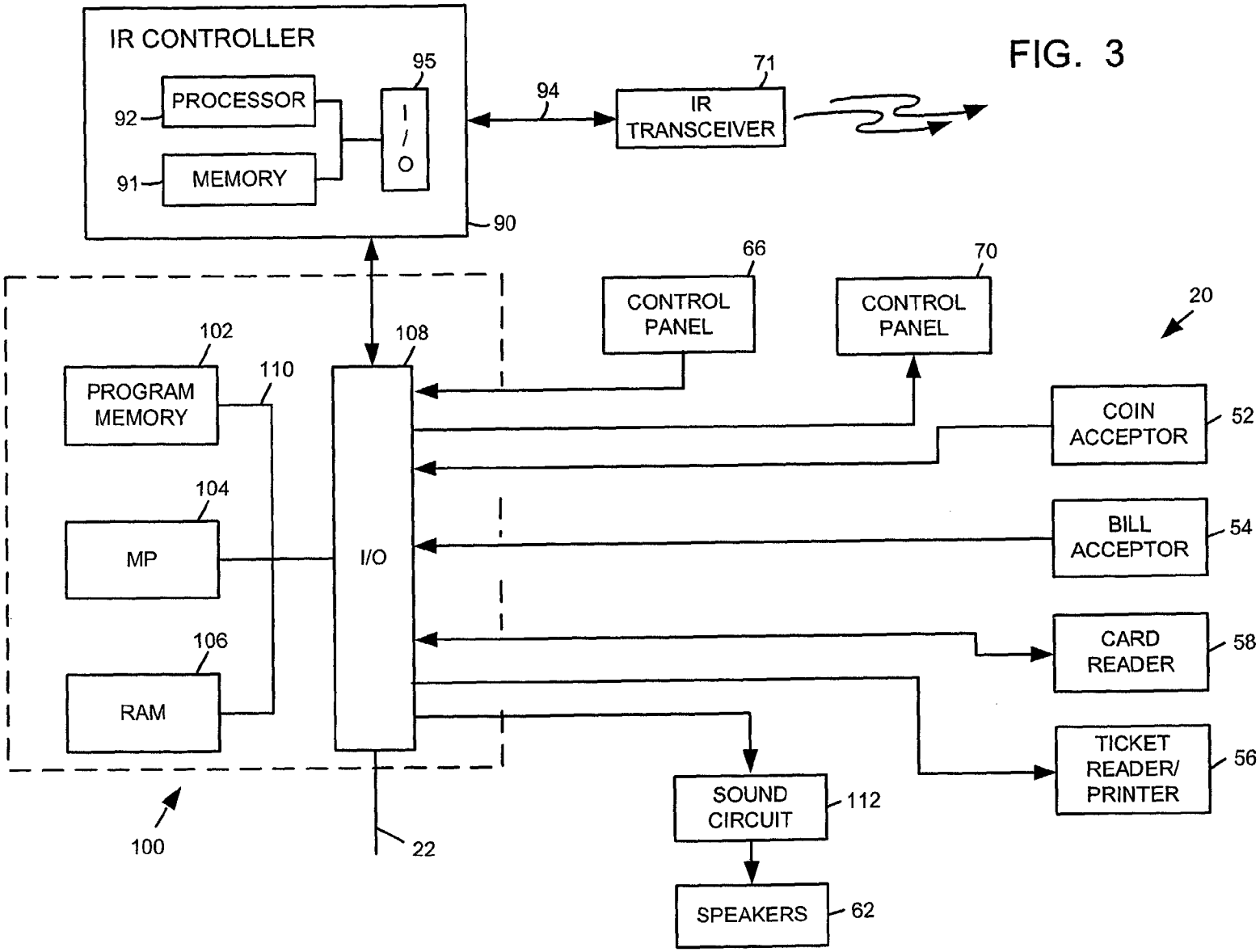
FIG. 3 is a block diagram of the electronic components of the gaming unit of FIG. 2.

FIG. 3 is a block diagram of a number of components that may be incorporated in the gaming unit 20. Referring to FIG. 3, the gaming unit 20 may include a gaming unit controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the gaming unit controller 100 may include multiple microprocessors 104. Similarly, the memory of the gaming unit controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

Although the program memory 102 is shown in FIG. 3 as a read-only memory (ROM) 102, the program memory of the gaming unit controller 100 may be a read/write or alterable memory, such as a hard disk. In the event a hard disk is used as a program memory, the address/data bus 110 shown schematically in FIG. 3 may comprise multiple address/data buses, which may be of different types, and there may be an I/O circuit disposed between the address/data buses.

The gaming unit controller 100 may be operatively coupled to an IR controller 90. Like the gaming unit controller 100, the IR controller 90 may comprise a program memory 90, a microcontroller or microprocessor 92, and an input/output device 95 interconnected via an address/data bus (not shown). The IR controller 90 may be electrically coupled to the transceiver 71 via a data signal line 94 The IR controller 90 may be any suitable controller capable of providing control for the IR transceiver 71. Although the IR controller 90 and the gaming unit controller 100 are shown as separate blocks, it should be understood that IR controller 90 and the gaming unit controller 100 may be depicted as a single block.

FIG. 3 illustrates that the control panel 66, the coin acceptor 52, the bill acceptor 54, the card reader 58 and the ticket reader/printer 56 may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound-synthesis circuit or that may comprise a driver circuit. The sound-generating circuit 112 may be coupled to the I/O circuit 108.

As shown in FIG. 3, the components 52, 54, 56, 58, 66, 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

Optical Transfer of Data

The optical transfer of data between devices may be accomplished via the use of one or more optical transceivers, in each device, electrically coupled to an optical communication controller. As previously mentioned in connection with FIGS. 1A and 1B, the optical wireless link 22 interconnecting the gaming unit(s) 20, and/or interconnecting one or more gaming unit(s) 20 with remote devices such as the central router 47, enables the optical transfer of data via the use of the IR transceiver 71 and the IR controller 90. For example, under the command of the IR controller 90, the IR transceiver 71 which may be, for example, an Infrared Data Association (IrDA) infrared data transceiver, a Fast Infrared (FIR) transceiver, a Serial Infrared (SIR) transceiver, etc., may provide optical transfer capability for gaming apparatus data and player data between the gaming unit(s) 20. The optical transfer of data may include both transmission and receipt of gaming apparatus data and player data. In addition to the optical transfer of data, the IR transceiver 71, generally implemented either in hardware and software or hardware alone, may perform shaping and other characteristics of infrared signals including encoding the data bits, framing data with begin and end of frame flags and cyclical redundancy checks. Further, in addition to infrared technology, other, short range, low power wireless technologies may be used to enable the optical transfer of data between devices.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the gaming unit controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C+, C++ or the like or any low-level, assembly or machine language. By storing the computer program portions therein, various portions of the memories 102, 106 are physically and/or structurally configured in accordance with computer program instructions.

Figure 4:
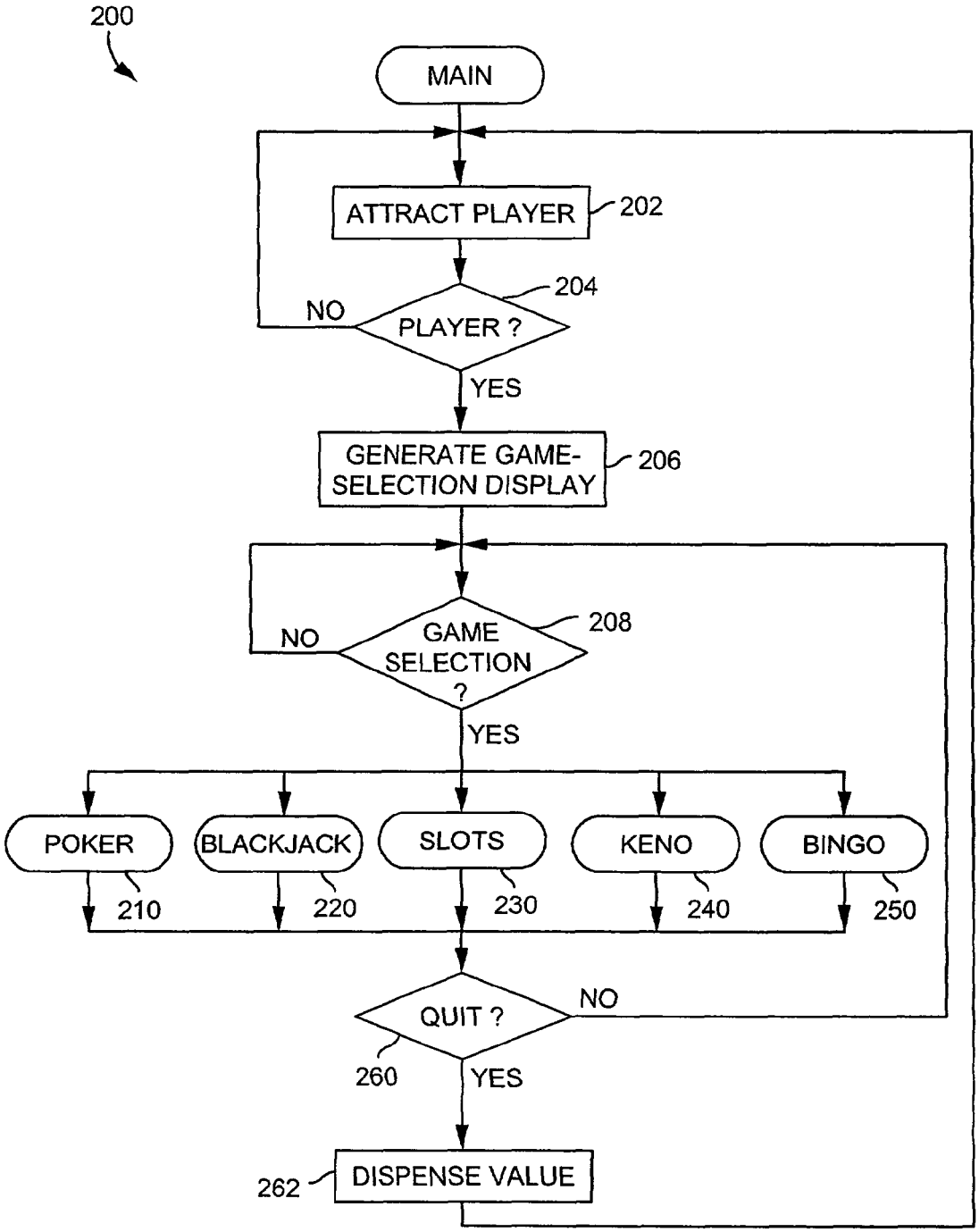
FIG. 4 is a flowchart of an embodiment of a main routine that may be performed during operation of one or more of the gaming units.

FIG. 4 is a flowchart of a main operating routine 200 that may be stored in the memory of the gaming unit controller 100. Referring to FIG. 4, the main routine 200 may begin operation at block 202 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc.

During performance of the attraction sequence, if a potential player makes any input to the gaming unit 20 as determined at block 204, the attraction sequence may be terminated and a game-selection display may be generated on the display unit 70 at block 206 to allow the player to select a game available on the gaming unit 20. The gaming unit 20 may detect an input at block 204 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at block 206 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of one of the games by the player as determined at block 208, the gaming unit controller 100 may cause one of a number of game routines to be performed to allow the selected game to be played. For example, the game routines could include a video poker routine 210, a video blackjack routine 220, a slots routine 230, a video keno routine 240, and a video bingo routine 250. At block 208, if no game selection is made within a given period of time, the operation may branch back to block 202.

After one of the routines 210, 220, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the gaming unit controller 100 may dispense value to the player at block 262 based on the outcome of the game(s) played by the player. The operation may then return to block 202. If the player did not wish to quit as determined at block 260, the routine may return to block 208 where the game-selection display may again be generated to allow the player to select another game.

It should be noted that although five gaming routines are shown in FIG. 4, a different number of routines could be included to allow play of a different number of games. The gaming unit 20 may also be programmed to allow play of different games.

Figure 5:
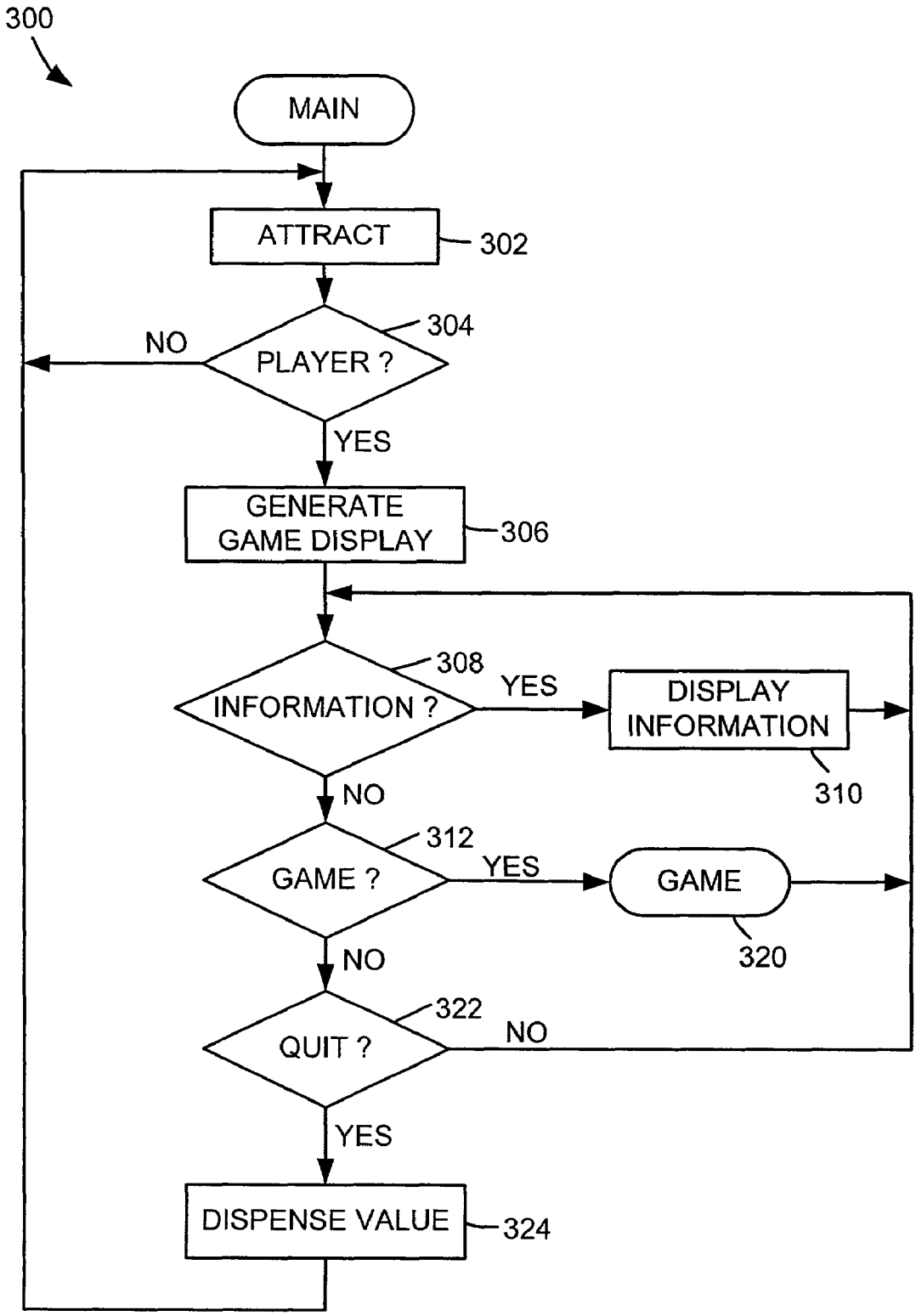
FIG. 5 is a flowchart of an alternative embodiment of a main routine that may be performed during operation of one or more of the gaming units.

FIG. 5 is a flowchart of an alternative main operating routine 300 that may be stored in the memory of the gaming unit controller 100. The main routine 300 may be utilized for gaming units 20 that are designed to allow play of only a single game or single type of game. Referring to FIG. 5, the main routine 300 may begin operation at block 302 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62.

During performance of the attraction sequence, if a potential player makes any input to the gaming unit 20 as determined at block 304, the attraction sequence may be terminated and a game display may be generated on the display unit 70 at block 306. The game display generated at block 306 may include, for example, an image of the casino game that may be played on the gaming unit 20 and/or a visual message to prompt the player to deposit value into the gaming unit 20. At block 308, the gaming unit 20 may determine if the player requested information concerning the game, in which case the requested information may be displayed at block 310. Block 312 may be used to determine if the player requested initiation of a game, in which case a game routine 320 may be performed. The game routine 320 could be any one of the game routines disclosed herein, such as one of the five game routines 210, 220, 230, 240, 250, or another game routine.

After the routine 320 has been performed to allow the player to play the game, block 322 may be utilized to determine whether the player wishes to terminate play on the gaming unit 20. If the player wishes to stop playing the gaming unit 20, which wish may be expressed, for example, by selecting a "Cash Out" button, the gaming unit controller 100 may dispense value to the player at block 324 based on the outcome of the game(s) played by the player. The operation may then return to block 302. If the player did not wish to quit as determined at block 322, the operation may return to block 308.

Video Poker

Figure 6:
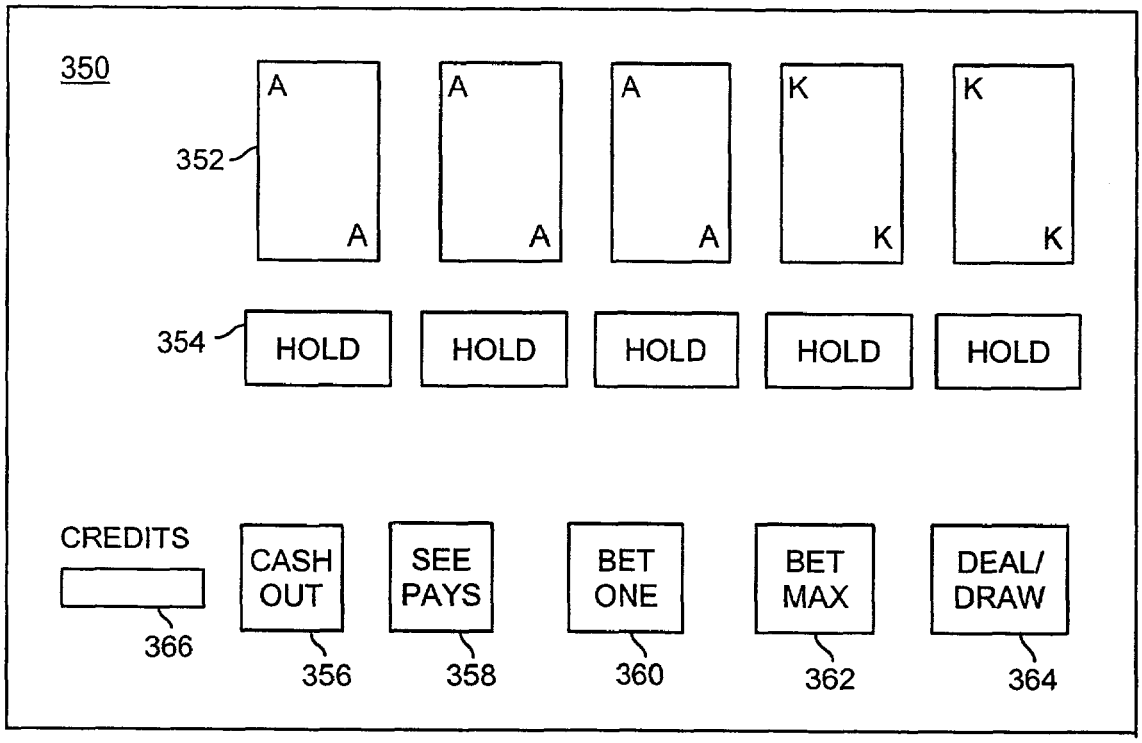
FIG. 6 is an illustration of an embodiment of a visual display that may be displayed during performance of the video poker routine of FIG. 8.

FIG. 6 is an exemplary display 350 that may be shown on the display unit 70 during performance of the video poker routine 210 shown schematically in FIG. 4. Referring to FIG. 6, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70.

Figure 8:
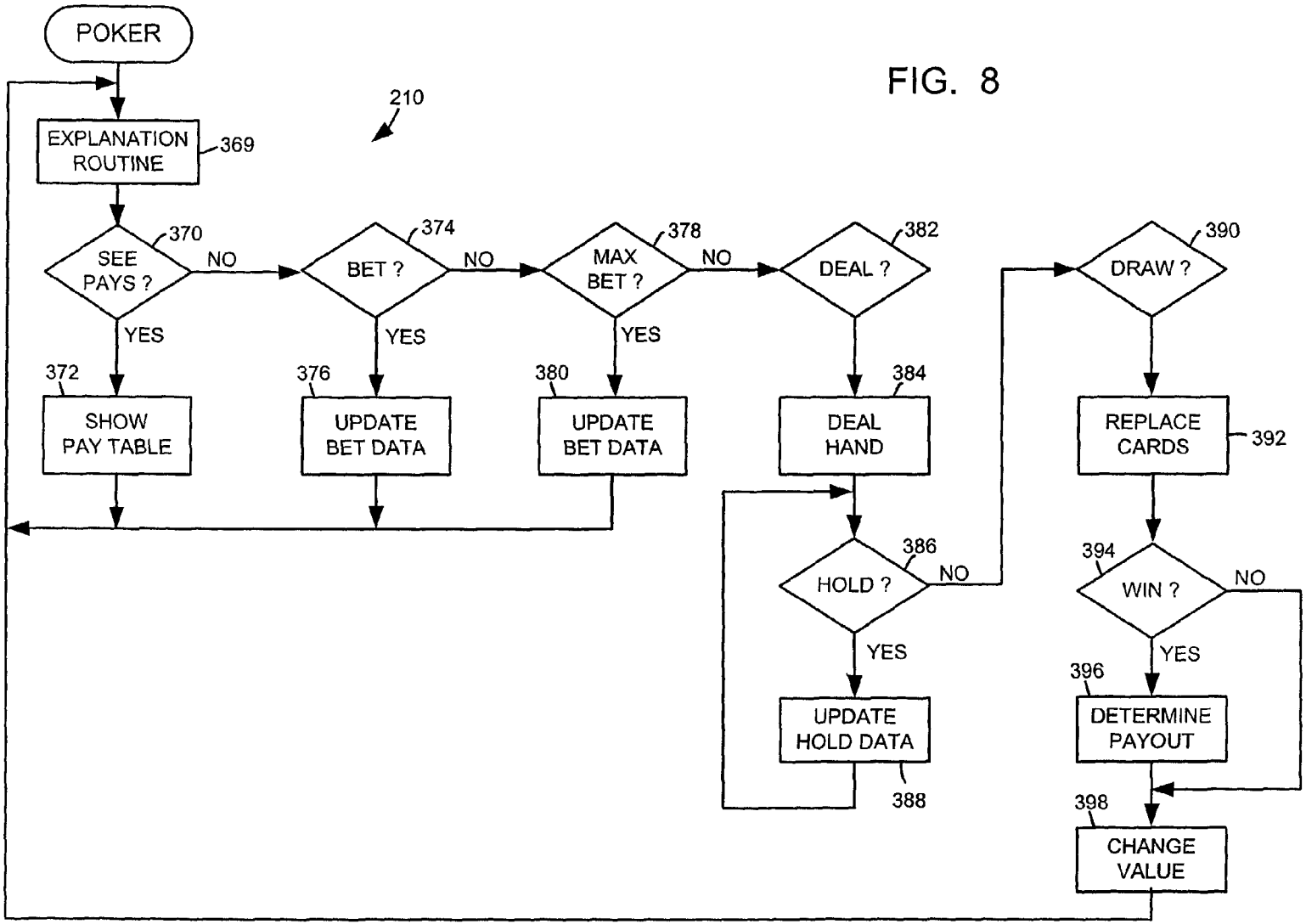
FIG. 8 is a flowchart of an embodiment of a video poker routine that may be performed by one or more of the gaming units.

FIG. 8 is a flowchart of the video poker routine 210 shown schematically in FIG. 4. Referring to FIG. 8, at block 370, the routine may determine whether the player has requested payout information, such as by activating the "See Pays" button 358, in which case at block 372 the routine may cause one or more pay tables to be displayed on the display unit 70. At block 374, the routine may determine whether the player has made a bet, such as by pressing the "Bet One Credit" button 360, in which case at block 376 bet data corresponding to the bet made by the player may be stored in the memory of the gaming unit controller 100. At block 378, the routine may determine whether the player has pressed the "Bet Max Credits" button 362, in which case at block 380 bet data corresponding to the maximum allowable bet may be stored in the memory of the gaming unit controller 100.

At block 382, the routine may determine if the player desires a new hand to be dealt, which may be determined by detecting if the "Deal/Draw" button 364 was activated after a wager was made. In that case, at block 384 a video poker hand may be "dealt" by causing the display unit 70 to generate the playing card images 352. After the hand is dealt, at block 386 the routine may determine if any of the "Hold" buttons 354 have been activated by the player, in which case data regarding which of the playing card images 352 are to be "held" may be stored in the gaming unit controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the gaming unit controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 6).

Although the video poker routine 210 is described above in connection with a single poker hand of five cards, the routine 210 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 7:
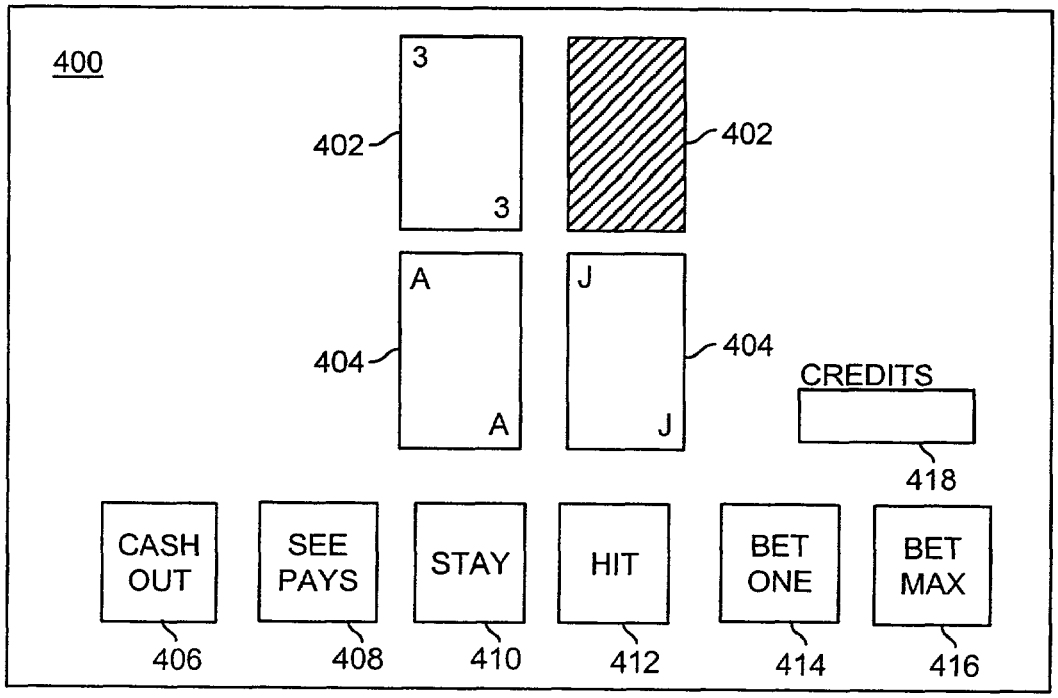
FIG. 7 is an illustration of an embodiment of a visual display that may be displayed during performance of the video blackjack routine of FIG. 9.

FIG. 7 is an exemplary display 400 that may be shown on the display unit 70 during performance of the video blackjack routine 220 shown schematically in FIG. 4. Referring to FIG. 7, the display 400 may include video images 402 of a pair of playing cards representing a dealer's hand, with one of the cards shown face up and the other card being shown face down, and video images 404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 408, a "Stay" button 410, a "Hit" button 412, a "Bet One Credit" button 414, and a "Bet Max Credits" button 416. The display 400 may also include an area 418 in which the number of remaining credits or value is displayed. If the display unit 70 is provided with a touch-sensitive screen, the buttons 406, 408, 410, 412, 414, 416 may form part of the video display 400. Alternatively, one or more of those buttons may be provided as part of a control panel that is provided separately from the display unit 70.

Figure 9:
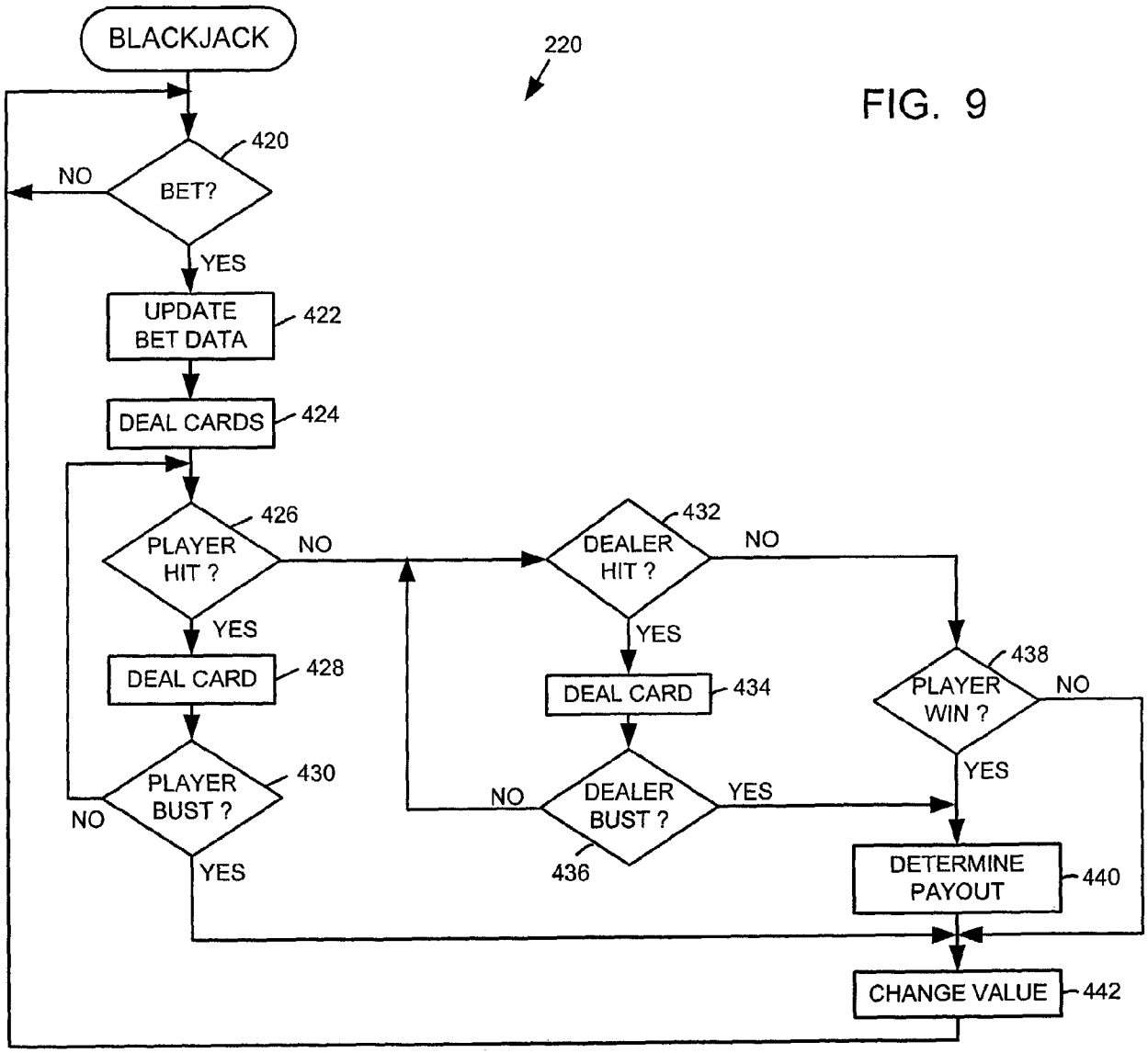
FIG. 9 is a flowchart of an embodiment of a video blackjack routine that may be performed by one or more of the gaming units.

FIG. 9 is a flowchart of the video blackjack routine 220 shown schematically in FIG. 4. Referring to FIG. 9, the video blackjack routine 220 may begin at block 420 where it may determine whether a bet has been made by the player. That may be determined, for example, by detecting the activation of either the "Bet One Credit" button 414 or the "Bet Max Credits" button 416. At block 422, bet data corresponding to the bet made at block 420 may be stored in the memory of the gaming unit controller 100. At block 424, a dealer's hand and a player's hand may be "dealt" by making the playing card images 402, 404 appear on the display unit 70.

At block 426, the player may be allowed to be "hit," in which case at block 428 another card will be dealt to the player's hand by making another playing card image 404 appear in the display 400. If the player is hit, block 430 may determine if the player has "bust," or exceeded 21. If the player has not bust, blocks 426 and 428 may be performed again to allow the player to be hit again.

If the player decides not to hit, at block 432 the routine may determine whether the dealer should be hit. Whether the dealer hits may be determined in accordance with predetermined rules, such as the dealer always hit if the dealer's hand totals 15 or less. If the dealer hits, at block 434 the dealer's hand may be dealt another card by making another playing card image 402 appear in the display 400. At block 436 the routine may determine whether the dealer has bust. If the dealer has not bust, blocks 432, 434 may be performed again to allow the dealer to be hit again.

If the dealer does not hit, at block 436 the outcome of the blackjack game and a corresponding payout may be determined based on, for example, whether the player or the dealer has the higher hand that does not exceed 21. If the player has a winning hand, a payout value corresponding to the winning hand may be determined at block 440. At block 442, the player's cumulative value or number of credits may be updated by subtracting the bet made by the player and adding, if the player won, the payout value determined at block 440. The cumulative value or number of credits may also be displayed in the display area 418 (FIG. 7).

Slots

FIG. 10 is an exemplary display 450 that may be shown on the display unit 70 during performance of the slots routine 230 shown schematically in FIG. 4. Referring to FIG. 10, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized.

To allow the player to control the play of the slots game, a plurality of player-selectable buttons may be displayed. The buttons may include a "Cash Out" button 456, a "See Pays" button 458, a plurality of payline-selection buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 12:
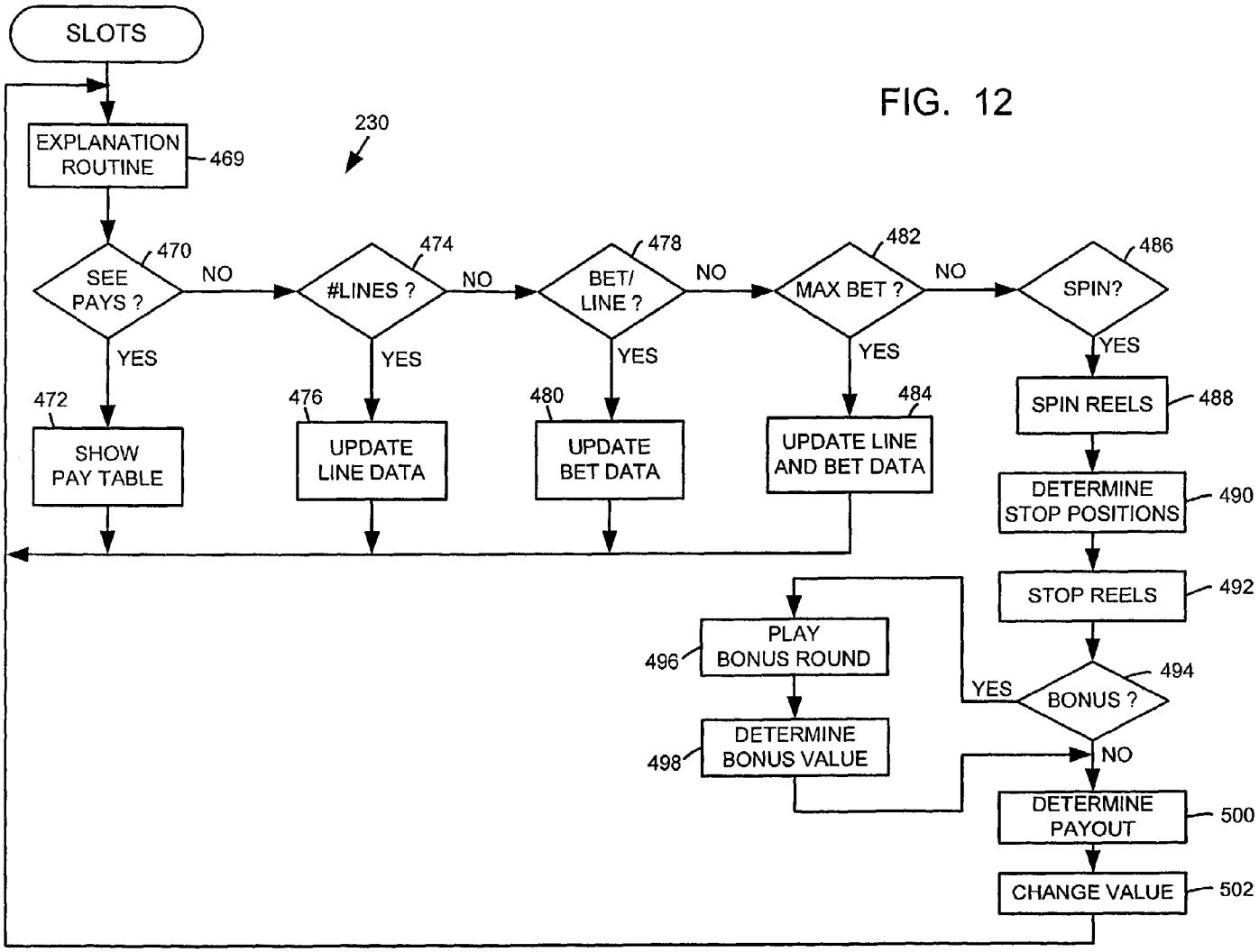
FIG. 12 is a flowchart of an embodiment of a slots routine that may be performed by one or more of the gaming units.

FIG. 12 is a flowchart of the slots routine 230 shown schematically in FIG. 10. Referring to FIG. 12, at block 470, the routine may determine whether the player has requested payout information, such as by activating the "See Pays" button 458, in which case at block 472 the routine may cause one or more pay tables to be displayed on the display unit 70. At block 474, the routine may determine whether the player has pressed one of the payline-selection buttons 460, in which case at block 476 data corresponding to the number of paylines selected by the player may be stored in the memory of the gaming unit controller 100. At block 478, the routine may determine whether the player has pressed one of the bet-selection buttons 462, in which case at block 480 data corresponding to the amount bet per payline may be stored in the memory of the gaming unit controller 100. At block 482, the routine may determine whether the player has pressed the "Max Bet" button 466, in which case at block 484 bet data (which may include both payline data and bet-per-payline data) corresponding to the maximum allowable bet may be stored in the memory of the gaming unit controller 100.

If the "Spin" button 464 has been activated by the player as determined at block 486, at block 488 the routine may cause the slot machine reel images 452 to begin "spinning" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the display unit 70, actual slot machine reels that are capable of being spun may be utilized instead.

Video Keno

FIG. 11 is an exemplary display 520 that may be shown on the display unit 70 during performance of the video keno routine 240 shown schematically in FIG. 4. Referring to FIG. 11, the display 520 may include a video image 522 of a plurality of numbers that were selected by the player prior to the start of a keno game and a video image 524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 526, a "See Pays" button 528, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive screen, the buttons may form part of the video display 520. Alternatively, one or more of those buttons may be provided as part of a control panel that is provided separately from the display unit 70.

Figure 13:
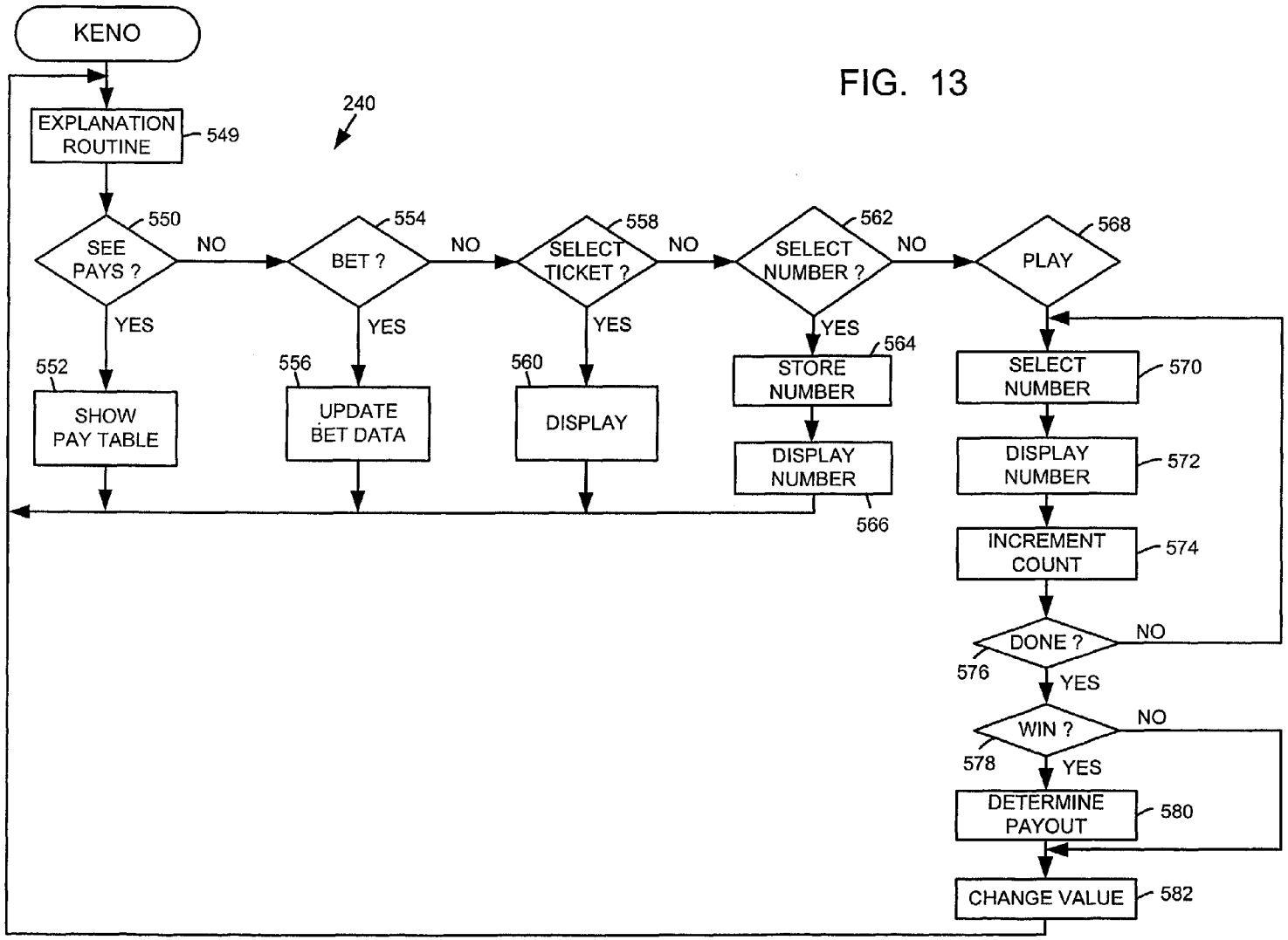
FIG. 13 is a flowchart of an embodiment of a video keno routine that may be performed by one or more of the gaming units.

FIG. 13 is a flowchart of the video keno routine 240 shown schematically in FIG. 4. The keno routine 240 may be utilized in connection with a single gaming unit 20 where a single player is playing a keno game, or the keno routine 240 may be utilized in connection with multiple gaming units 20 where multiple players are playing a single keno game. In the latter case, one or more of the acts described below may be performed either by the gaming unit controller 100 in each gaming unit or by one of the network computer 22, 32 to which multiple gaming units 20 are operatively connected.

Referring to FIG. 13, at block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the gaming unit controller 100. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the gaming unit controller 100 at block 564 and may be included in the image 522 on the display 520 at block 566. After a certain amount of time, the keno game may be closed to additional players (where a number of players are playing a single keno game using multiple gambling units 20).

If play of the keno game is to begin as determined at block 568, at block 570 a game number within a range set by the casino may be randomly selected either by the gaming unit controller 100 or a central computer operatively connected to the controller, such as one of the network computers 22, 32. At block 572, the randomly selected game number may be displayed on the display unit 70 and the display units 70 of other gaming units 20 (if any) which are involved in the same keno game. At block 574, the gaming unit controller 100 (or the central computer noted above) may increment a count which keeps track of how many game numbers have been selected at block 570.

At block 576, the gaming unit controller 100 (or one of the network computers 22, 32) may determine whether a maximum number of game numbers within the range have been randomly selected. If not, another game number may be randomly selected at block 570. If the maximum number of game numbers has been selected, at block 578 the gaming unit controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits may also be displayed in the display area 540 (FIG. 11).

Video Bingo

Figure 14:
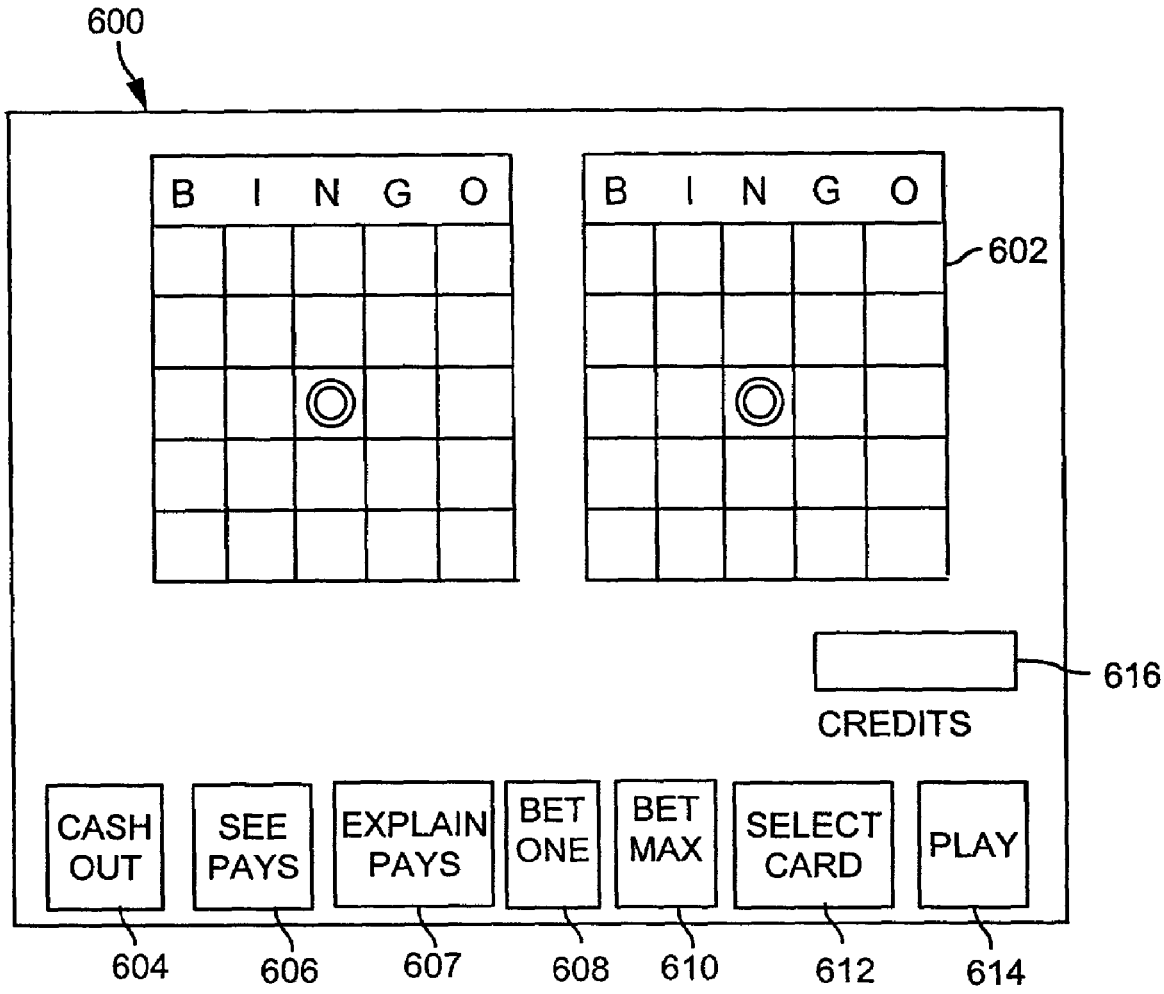
FIG. 14 is an illustration of an embodiment of a visual display that may be displayed during performance of the video bingo routine of FIG. 15.

FIG. 14 is an exemplary display 600 that may be shown on the display unit 70 during performance of the video bingo routine 250 shown schematically in FIG. 4. Referring to FIG. 14, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively, one or more of those buttons may be provided as part of a control panel that is provided separately from the display unit 70.

Figure 15:
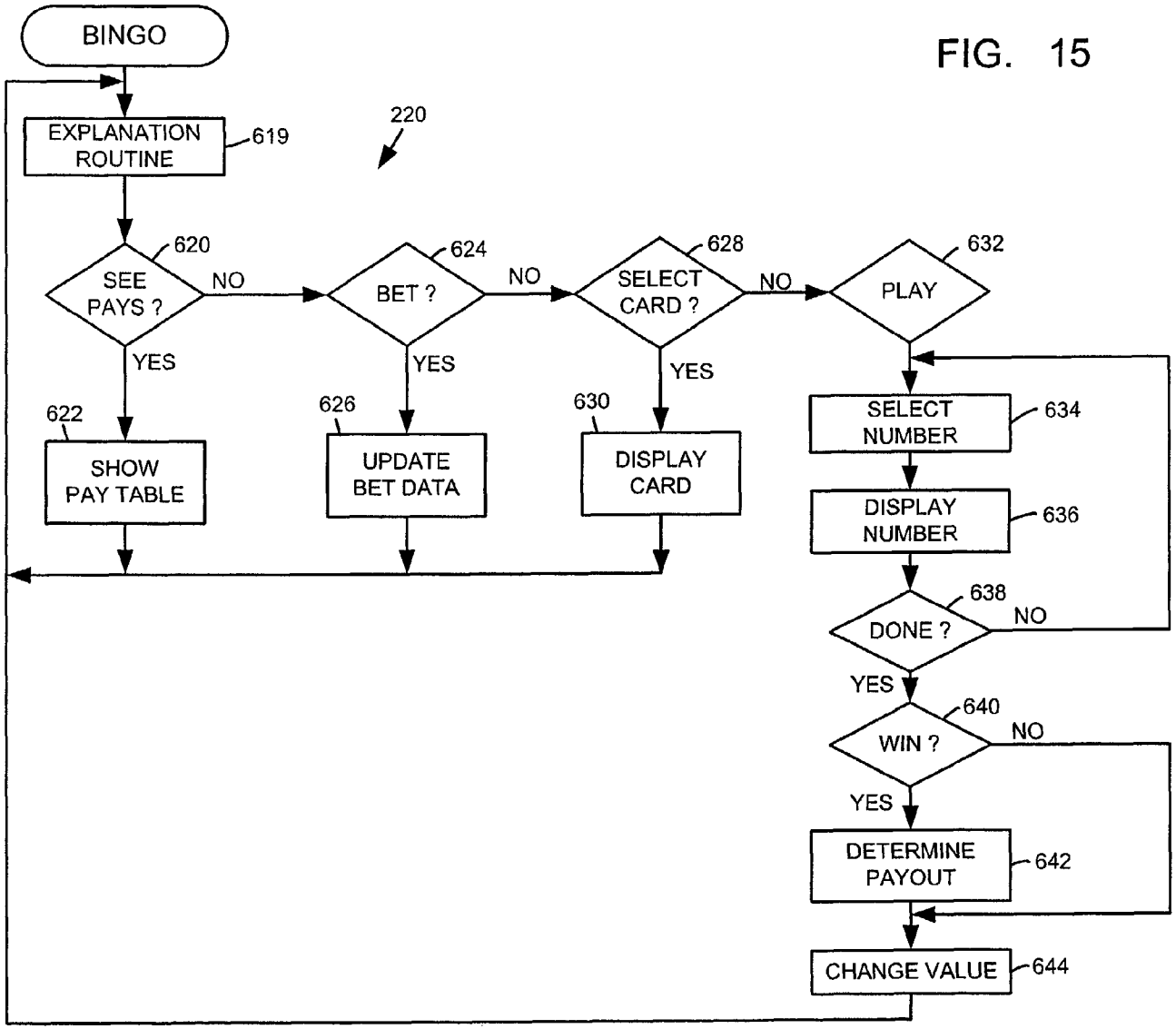
FIG. 15 is a flowchart of an embodiment of a video bingo routine that may be performed by one or more of the gaming units.

FIG. 15 is a flowchart of the video bingo routine 250 shown schematically in FIG. 4. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the gaming unit controller 100 in each gaming unit 20 or by one of the network computers 22, 32 to which multiple gaming units 20 are operatively connected.

Referring to FIG. 15, at block 620, the routine may determine whether the player has requested payout information, such as by activating the "See Pays" button 606, in which case at block 622 the routine may cause one or more pay tables to be displayed on the display unit 70. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the gaming unit controller 100.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the gaming unit controller 100 or a central computer such as one of the network computers 22, 32. At block 636, the bingo number may be displayed on the display unit 70 and the display units 70 of any other gaming units 20 involved in the bingo game.

At block 638, the gaming unit controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits may also be displayed in the display area 616 (FIG. 14).

What is claimed is:

1. A gaming system comprising:

a first gaming unit comprising:

a housing;

a candle coupled to said housing;

an optical communication transceiver disposed in said candle, said optical communication transceiver being capable of wireless data transmission and reception, said optical communication transceiver comprising a photoemissive device capable of generating infrared light and a photoreceptor device capable of receiving infrared light, both of which are disposed in the candle;

an optical communication controller coupled to said optical communication transceiver, said optical communication controller comprising a processor and a memory operatively coupled to said processor, said optical communication controller being programmed to allow wireless data reception of computer programs;

a display unit that is capable of generating video images;

a value input device;

a gaming unit controller operatively coupled to said display unit and said value input device, said gaming unit controller comprising a processor and a memory operatively coupled to said processor of said gaming unit controller, said gaming unit controller being programmed to allow a person to make a wager, said gaming unit controller of being programmed to cause a video image to be generated on said display unit, said video image representing a game, and said gaming unit controller being programmed to determine a value payout associated with an outcome of said game represented by said video image;

a second gaming unit comprising:

a housing;

a candle coupled to said housing of said second gaming unit;

an optical communication transceiver disposed in said candle of said second gaming unit, said optical communication transceiver of said second gaming unit being capable of wireless data transmission and reception, said optical communication transceiver of said second gaming unit comprising a photoemissive device capable of generating infrared light and a photoreceptor device capable of receiving infrared light, both of which are disposed in the candle of said second gaming unit;

an optical communication controller coupled to said optical communication transceiver of said second gaming unit, said optical communication controller of said second gaming unit comprising a processor and a memory operatively coupled to said processor of said optical communication controller of said second gaming unit, said optical communication controller of said second gaming unit being programmed to allow wireless data communication with said optical communication transceiver of said first gaming unit, said optical communication controller of said second gaming unit being programmed to allow wireless data reception of computer programs;

a display unit that is capable of generating video images;

a value input device;

a gaming unit controller operatively coupled to said display unit of said second gaming unit and said value input device of said second gaming unit, said gaming unit controller of said second gaming unit comprising a processor and a memory operatively coupled to said processor of said gaming unit controller of said second gaming unit, said gaming unit controller of said second gaming unit being programmed to allow a person to make a wager, said gaming unit controller of said second gaming unit being programmed to cause a video image to be generated on said display unit of said second gaming unit, said video image representing a game, and said gaming unit controller of said second gaming unit being programmed to determine a value payout associated with an outcome of said game represented by said video image; and a routing device that is capable of point-to-multipoint communication, said routing device comprising:

an optical communication transceiver capable of wireless data transmission and reception; and a routing device controller comprising a processor and a memory, said routing device controller being programmed to allow communication with said optical communication transceivers of said first and second gaming units.

2. The gaming system as defined in claim 1, wherein said optical communication transceivers of said first and second gaming units and said routing device each comprise a fast infrared (FIR) transceiver.

3. The gaming system as defined in claim 1, wherein said optical communication transceivers of said first and second gaming units and said routing device each comprise a serial infrared (SIR) transceiver.

4. A gaming system comprising:

a first gaming unit comprising:

a housing;

a candle coupled to said housing;

an optical communication transceiver disposed in said candle, said optical communication transceiver being capable of wireless data transmission and reception, said optical communication transceiver comprising a photoemissive device capable of generating infrared light and a photoreceptor device capable of receiving infrared light, both of which are disposed in the candle;

an optical communication controller coupled to said optical communication transceiver, said optical communication controller comprising a processor and a memory operatively coupled to said processor;

a display unit that is capable of generating video images;

a value input device;

a gaming unit controller operatively coupled to said display unit and said value input device, said gaming unit controller comprising a processor and a memory operatively coupled to said processor of said gaming unit controller, said gaming unit controller being programmed to allow a person to make a wager, said gaming unit controller of being programmed to cause a video image to be generated on said display unit, said video image representing a game, and said gaming unit controller being programmed to determine a value payout associated with an outcome of said game represented by said video image;

a second gaming unit comprising:

a housing;

a candle coupled to said housing of said second gaming unit;

an optical communication transceiver disposed in said candle of said second gaming unit, said optical communication transceiver of said second gaming unit being capable of wireless data transmission and reception, said optical communication transceiver of said second gaming unit comprising a photoemissive device capable of generating infrared light and a photoreceptor device capable of receiving infrared light, both of which are disposed in the candle of said second gaming unit;

an optical communication controller coupled to said optical communication transceiver of said second gaming unit, said optical communication controller of said second gaming unit comprising a processor and a memory operatively coupled to said processor of said optical communication controller of said second gaming unit, said optical communication controller of said second gaming unit being programmed to allow wireless data communication with said optical communication transceiver of said first gaming unit;

a display unit that is capable of generating video images;

a value input device;

a gaming unit controller operatively coupled to said display unit of said second gaming unit and said value input device of said second gaming unit, said gaming unit controller of said second gaming unit comprising a processor and a memory operatively coupled to said processor of said gaming unit controller of said second gaming unit, said gaming unit controller of said second gaming unit being programmed to allow a person to make a wager, said gaming unit controller of said second gaming unit being programmed to cause a video image to be generated on said display unit of said second gaming unit, said video image representing a game, and said gaming unit controller of said second gaming unit being programmed to determine a value payout associated with an outcome of said game represented by said video image; and a routing device comprising:

an optical communication transceiver capable of wireless data transmission and reception; and a routing device controller comprising a processor and a memory, said routing device controller being programmed to allow communication with said optical communication transceivers of said first and second gaming units.

5. The gaming system as defined in claim 4, wherein said routing device controller is programmed to allow communication with said optical communication transceiver of said first gaming unit, wherein said optical communication controller of said first gaming unit is programmed to allow communication with said optical communication transceiver of said routing device, wherein said optical communication controller of said first gaming unit is programmed to allow communication with said optical communication transceiver of said second gaming unit, and wherein said optical communication controller of said second gaming unit is programmed to allow communication with said optical communication transceiver of first second gaming unit.

6. The gaming system as defined in claim 4, wherein said routing device controller is programmed to allow communication with said optical communication transceiver of said first gaming unit and said optical communication transceiver of second gaming unit, wherein said optical communication controller of said first gaming unit is programmed to allow communication with said optical communication transceiver of said routing device, and wherein said optical communication controller of said second gaming unit is programmed to allow communication with said optical communication transceiver of said routing device.

7. A gaming system comprising:

a first gaming unit comprising:

a housing;

a candle coupled to said housing;

an optical communication transceiver disposed in said candle, said optical communication transceiver being capable of wireless data transmission and reception, said optical communication transceiver comprising a photoemissive device capable of generating infrared light and a photoreceptor device capable of receiving infrared light, both of which are disposed in the candle;

an optical communication controller coupled to said optical communication transceiver, said optical communication controller comprising a processor and a memory operatively coupled to said processor;

a display unit that is capable of generating video images;

a value input device;

a gaming unit controller operatively coupled to said display unit and said value input device, said gaming unit controller comprising a processor and a memory operatively coupled to said processor, said gaming unit controller being programmed to allow a person to make a wager, said gaming unit controller of being programmed to cause a video image to be generated on said display unit, said video image representing a game, and said gaming unit controller being programmed to determine a value payout associated with an outcome of said game represented by said video image;

a second gaming unit comprising:

a housing;

a candle coupled to said housing of said second gaming unit;

an optical communication transceiver disposed in said candle of said second gaming unit, said optical communication transceiver of said second gaming unit being capable of wireless data transmission and reception, said optical communication transceiver of said second gaming unit comprising a photoemissive device capable of generating infrared light and a photoreceptor device capable of receiving infrared light, both of which are disposed in the candle of said second gaming unit;

an optical communication controller coupled to said optical communication transceiver of said second gaming unit and said gaming unit controller of said second gaming unit, said optical communication controller of said second gaming unit comprising a processor and a memory operatively coupled to said processor of said optical communication controller of said second gaming unit, said optical communication controller of said second gaming unit being programmed to allow wireless data communication with said optical communication transceiver of said first gaming unit;

a display unit that is capable of generating video images;

a value input device;

a gaming unit controller operatively coupled to said display unit of said second gaming unit and said value input device of said second gaming unit, said gaming unit controller of said second gaming unit comprising a processor and a memory operatively coupled to said processor of said second gaming unit, said gaming unit controller of said second gaming unit being programmed to allow a person to make a wager, said gaming unit controller of said second gaming unit being programmed to cause a video image to be generated on said display unit of said second gaming unit, said video image representing a game, and said gaming unit controller of said second gaming unit being programmed to determine a value payout associated with an outcome of said game represented by said video image;

a common optical communication transceiver capable of wireless data transmission and reception, said common optical communication transceiver being optically coupled to said optical communication transceivers of said first and second gaming units; and a common controller operatively coupled to said common optical communication transceiver, said common controller comprising a processor and a memory operatively coupled to said processor of said common controller, said common controller being programmed to facilitate communication between said common optical communication transceiver and said optical communication transceivers of said first and second gaming units.

8. A gaming apparatus, comprising:

a housing;

a candle coupled to said housing;

an optical communication transceiver disposed in said candle, said optical communication transceiver being capable of wireless data transmission and reception, said optical communication transceiver comprising a photoemissive device capable of generating infrared light and a photoreceptor device capable of receiving infrared light, both of which are disposed in the candle;

an optical communication controller coupled to said optical communication transceiver, said optical communication controller comprising a processor and a memory operatively coupled to said processor, said optical communication controller being programmed to allow wireless data communication with an optical communication transceiver of another device at a location remote from said gaming apparatus;

a display unit that is capable of generating video images;

a value input device;

a gaming unit controller operatively coupled to said display unit and said value input device, said gaming unit controller comprising a processor and a memory operatively coupled to said processor of said gaming unit controller, said gaming unit controller being programmed to allow a person to make a wager, said gaming unit controller being programmed to cause a video image representing a game to be generated on said display unit, said video image representing one of the following games: video poker, video blackjack, video slots, video keno or video bingo, said video image comprising an image of at least five playing cards if said game comprises video poker, said video image comprising an image of a plurality of simulated slot machine reels if said game comprises video slots, said video image comprising an image of a plurality of playing cards if said game comprises video blackjack, said video image comprising an image of a plurality of keno numbers if said game comprises video keno, said video image comprising an image of a bingo grid if said game comprises video bingo, and said gaming unit controller being programmed to determine a value payout associated with an outcome of said game.

9. The gaming apparatus as defined in claim 8, wherein said optical communication controller is programmed to allow communication with an optical communication transceiver of a routing device, and wherein said optical communication controller is programmed to allow communication with an optical communication transceiver of a second gaming unit.

10. The gaming apparatus as defined in claim 8, wherein said optical communication controller is programmed to allow communication with an optical communication transceiver of a routing device.

11. A gaming unit in a casino gaming network, comprising:

a housing;

a master gaming controller;

memory;

a first display;

a candle unit comprising a first visible light source and a first wireless transceiver being operable to transmit wireless data signals and operable to receive wireless data signals;

the first wireless transceiver being implemented as an integrated optical communication transceiver comprising a photoemissive device operable to generate infrared light and a photoreceptor device operable to detect or receive infrared light;

the gaming device being operable to:

control a wager-based game played on the gaming unit;

engage in direct bi-directional wireless communication, via the first wireless transceiver, with at least one other device of the casino gaming network.

12. The gaming unit of claim 11 being further operable to:

engage in direct bi-directional wireless communication, via the first wireless transceiver, with a second gaming unit using the first wireless communication interface; and engage in direct bi-directional wireless communication, via the first wireless transceiver, with an optical routing device.

* * * * *